US006066793A

United States Patent [19]

Ogai et al.

[11] Patent Number: 6,066,793

[45] Date of Patent: May 23, 2000

[54] DEVICE AND METHOD FOR EXECUTING CONTROL TO SHIFT TONE-GENERATION START TIMING AT PREDETERMINED BEAT

[75] Inventors: Yoichiro Ogai; Takao Yamamoto, both of Hamamatsu, Japan

[73] Assignee: Yamaha Corporation, Hamamatsu, Japan

[21] Appl. No.: 09/058,307

[22] Filed: Apr. 9, 1998

[30] Foreign Application Priority Data

Apr. 16, 1997 [JP] Japan ..... 9-113661

[51] Int. Cl.[7] ..... G10H 1/18; G10H 7/00

[52] U.S. Cl. ..... 84/615; 84/626; 84/653; 84/662

[58] Field of Search ..... 84/609–612, 615–617, 84/626–627, 634–636, 649–655, 662–663

[56] References Cited

U.S. PATENT DOCUMENTS 5,189,238 2/1993 Hayakawa ..... 84/609
5,218,158 6/1993 Kimura ..... 84/663

*Primary Examiner*—Robert E. Nappi
*Assistant Examiner*—Marlon T. Fletcher
*Attorney, Agent, or Firm*—Graham & James LLP

[57] ABSTRACT

In executing a music performance on the basis of supplied performance data, a feeling of swing can be imparted to the performance by delaying tone-generation start time of a tone, based on the performance data, at each predetermined beat such as upbeat. In this case, if an original tone-generation end time of the tone to be delayed is ahead of tone-generation start time of a next tone, control is executed to automatically change a duration of the tone in such a manner that actual tone-generation end time of the delayed note comes ahead of the tone-generation start time of the next tone. In this manner, the delay control can be properly executed on staccato performance data without losing characteristics of staccato. If, on the other hand, the original tone-generation end time of the tone to be delayed is behind the tone-generation start time of the next tone, control is executed to automatically change the duration of the tone in such a manner that the actual tone-generation end time of the delayed tone comes behind the tone-generation start time of the next tone. In this manner, the delay control can be properly executed on legato performance data without losing characteristics of legato.

20 Claims, 8 Drawing Sheets

| key_number | 0 | 1 | 2 | 3 | 4 | ····· | 126 | 127 |
|---|---|---|---|---|---|---|---|---|
| NUMBER OF TO-BE-SOUNDED NOTES | 0 | 0 | 1 | 0 | 2 | ····· | 0 | 0 |

DEVICE AND METHOD FOR EXECUTING CONTROL TO SHIFT TONE-GENERATION START TIMING AT PREDETERMINED BEAT

BACKGROUND OF THE INVENTION

The present invention relates generally to performance control devices and methods suitable for use with tone generating devices that generate tones in accordance with performance data supplied thereto, and more particularly to a technique by which a performance effect with a feeling of swing can be selectively imparted to a musical performance based on supplied performance data.

Performance control technique has been conventionally known which, during the course of a music performance based on square performance data, executes control to delay tone-generation start time at each even-numbered beat (upbeat) to thereby produce a feeling of "swing" as often found in, for example, a jazz performance. To selectively execute an automatic performance giving a feeling of swing, it has been conventional to carry out so-called "swing processing" where selected performance data are subjected to a delay process for a swing effect.

The conventional swing processing will be discussed below with reference to FIG. 2. In FIG. 2, item A represents a time of one measure and each "step time" within the measure is chosen to equal the length of a quarter note corresponding to 120 clock pulses; thus, one measure has a length corresponding to 480 clock pulses. Note that each clock pulse represents timer-interrupt timing in a tone generating device.

At "(a)" of item B in FIG. 2, performance data to be performed in staccato such that no overlap of two successive tones occurs are shown as a pulse waveform. In the pulse waveform, each of rising edge times t0, t1, t2 and t3 represents tone-generation start (key-on) timing, each of falling edge times represents tone-generation end (key-off) timing, and each tone-generation lasting period or duration from the key-on timing to the corresponding key-off timing is denoted as a gate time (Gate time). Item B in FIG. 2 shows an example where the ratio of each even-numbered-beat gate time to the step time (gate ratio or G) is chosen to be smaller than "1". Thus, if the gate ratio is 0.8 (G=0.8) as shown, "Gate time 1" equals 96 clock pulses (120 clock pulses×0.8).

At "(b)" of item B in FIG. 2, there are shown performance data obtained by applying the swing processing to the performance data ("data swing-processed by conventional"). In the illustrated example, key-on timing of a first even-numbered-beat note (second note in the measure) is shown as delayed, through the swing processing, by a time corresponding to 50 clock pulses. Namely, the time corresponding to 50 clock pulses is set as the swing time, so that sounding or tone generation of the even-numbered-beat note, which is originally set to start at time t1, is initiated upon lapse of 50 clock pulses from time t1, with the result that the even-numbered-beat note having undergone the swing processing overlaps a third-beat note in the measure.

Further, at "(a)" of item C in FIG. 2, performance data to be performed in legato such that two successive tones overlap each other are shown as a pulse waveform. In the pulse waveform, each of rising edge times t0, t1, t2 and t3 represents tone-generation start (key-on) timing, each of falling edge times represents tone-generation end (key-off) timing, and the duration from the key-on timing to the corresponding key-off timing is denoted as a gate time (Gate time). Note that item C in FIG. 2 shows an example where the ratio of each gate time to the step time (gate ratio or G) is chosen to be not smaller than "1" and not greater than "2" ($1 \leqq \text{Gate} \leqq 2$). Thus, if the gate ratio is 1.2 (G=1.2) as shown, "Gate time 1" equals 144 clock pulses (120 clock pulses× 1.2).

At "(b)" of item C in FIG. 2, there are shown performance data obtained by applying the swing processing to the performance data ("data swing-processed by conventional"). In the illustrated example, key-on timing of a first even-numbered-beat note (second note in the measure) is shown as delayed, through the swing processing, by a time corresponding to 50 clock pulses. Namely, the time corresponding to 50 clock pulses is set as the swing time, so that sounding of the even-numbered-beat note, which is originally set to start at time t1, is initiated 50 clock pulses after time t1, with the result that the even-numbered-beat note having undergone the swing processing significantly overlaps a third-beat note in the measure.

If the conventional swing processing is applied to performance data that are to be performed in staccato, key-off timing of the swing-processed tone occurs after key-on timing of a next one, as shown at (b) of item B in FIG. 2. Thus, the swing processing would create a period when the two successive tones are generated simultaneously in an overlapping manner, and as a consequence, a staccato performance would undesirably result in a legato-like performance contrary to player's intent.

Further, if the conventional swing processing is applied to performance data that are to be performed in legato, key-off timing of the swing-processed tone would be so delayed that the tone significantly overlaps the next tone as shown at (b) of item C in FIG. 2, and the key-off timing of the swing-processed tone could be delayed great enough to come behind key-on timing of a tone following the next one. For example, where the second and third notes are to be performed in legato and the third and fourth notes are to be performed in staccato, the conventional swing processing would present a problem. The performance could not be carried out as originally intended because the seconds note would overlap the cessation of the third note and the onset of the fourth note. Thus, the listener would not perceive the intended intervening break between the third and forth notes. This adverse effect would become particularly serious when same-pitch notes are to be sounded successively in staccato, because attack portions of notes following the first-sounded note are unavoidably lost, as will be detailed below with reference to FIGS. 9A and 9B.

FIG. 9A shows a manner in which same-pitch notes are performed in staccato on the basis of performance data not having undergone the swing processing, while FIG. 9B shows a manner in which the same-pitch notes are performed in staccato on the basis of the performance data having undergone the swing processing. In the example of FIG. 9A, the tone volume rises sharply at key-on timing of the first note, then slightly falls and then becomes stable. The tone volume rising portion is commonly called an "attack portion". If key-on timing of the second note comes after the key-off timing of the first note as shown in FIG. 9A, then the first and second notes can be sounded without the respective attack portions being lost.

However, if the key-on timing of the first note is delayed, by the swing processing, to come after the key-on timing of the second note as shown in FIG. 9B, the first and second notes would be sounded simultaneously, and thus the attack portion of the second note having the same pitch as the first note would be undesirably lost as denoted in broken line. Due to the loss of the attack feeling of the second note, the performance as a whole would greatly differ from what was originally intended by the player.

Also, if, when a plurality of same-pitch notes are being sounded, key-off operation for that pitch is executed in response to a key-off signal of the first note, all the other notes of the pitch following the first note would be undesirably caused to stop sounding together.

Further, if, in the case where the swing processing is applied to each even-numbered beat, the user sets the processing to be executed during repetitive reproduction of performance data consisting of, for example, nine beats, then the swing processing is not effected at a ninth beat (which is an odd-numbered beat) in the first reproduction of the performance data but effected at a first beat (which is also an odd-numbered beat) in the next or second reproduction. Because the swing processing is thus applied to the first beat in the second reproduction (i.e., a tenth beat in the swing-processed performance data) although the first beat must always be left uninfluenced by the swing processing, the performance data would become 18-beat data that was not intended by the player.

SUMMARY OF THE INVENTION

It is therefore a primary object of the present invention to provide a performance control device and method which can execute swing processing on performance data without losing originally-intended characteristics of the performance data.

It is a second object of the present invention to provide a tone generating device which, when a plurality of same-pitch notes are being sounded simultaneously, can prevent the sounding of all the same-pitch notes from being terminated together at key-off timing of a leading one of the notes.

According to one aspect of the present invention, there is provided a performance control device which comprises: a first section that supplies performance data; a second section that executes control to change tone-generation start time of a tone based on the performance data supplied by the first section; and a third section that, when the tone-generation start time of the tone is changed via the second section, executes control to automatically change the duration of the tone in response to the changed tone-generation start time.

The above-mentioned control to change tone-generation start time of a tone based on the performance data is intended to selectively delay tone-generation start time of tones corresponding to predetermined beats. If the predetermined beats are upbeats, then a feeling of swing can be imparted by appropriately delaying tone-generation start time of each of the upbeat tones. That is, even where the original performance data supplied by the first section lacks a feeling of swing, the second section can execute performance control to impart such an feeling of swing to the performance data. If the duration of the tone whose tone-generation start time has been delayed is left unchanged from that in the supplied original performance data, tone-generation end time of the tone would be delayed accordingly to cause an unwanted interference with tone generation of a next tone, as discussed earlier as the prior art problem. The third section operates to avoid such an inconvenience. Namely, when the tone-generation start time of the tone has been changed, the third section automatically changes the tone-generation lasting period of the tone in response to the changed tone-generation start time, to thereby effect appropriate control such that actual tone-generation end time of the tone comes ahead of or before the tone-generation start time of the next tone.

In one implementation, where the original tone-generation end time of the tone determined by the supplied performance data is ahead of the tone-generation start time of the next tone, the third section executes the control to automatically change the duration of the tone in such a manner that actual tone-generation end time of the tone whose tone-generation start time has been changed via the second section comes ahead of the tone-generation start time of the next tone. Thus, where the control to delay tone-generation start time is to be executed on staccato performance data for impartment of a feeling of swing, the control is achieved such that the actual tone-generation end time of the tone, without fail, comes ahead of the tone-generation start time of the next tone despite the delayed tone-generation start time. As a consequence, the delay control can be properly executed on the staccato performance data without losing characteristics of staccato.

In another implementation, where the original tone-generation end time of the tone determined by the supplied performance data is behind the tone-generation start time of the next tone, the third section executes the control to automatically changed the duration of the tone in such a manner that actual tone-generation end time of the tone, whose tone-generation start time has been changed via the second section, comes behind the tone-generation start time of the next tone. Thus, where the control to delay tone-generation start time is to be executed on legato performance data for impartment of a feeling of swing, the control is achieved such that the actual tone-generation end time of the tone, without fail, comes behind the tone-generation start time. As a consequence, the delay control can be properly executed on the legato performance data without losing characteristics of legato. In this case, if the actual tone-generation end time of the tone, whose tone-generation start time has been changed via the second section, is controlled to coincide with or come slightly ahead or behind the original tone-generation end time, the present invention can avoid the inconvenience that the actual tone-generation end time of the tone comes after the tone-generation end time of the next tone due to the delayed tone-generation start time.

Thus, even when swing processing is applied to performance data to be performed in staccato, the present invention arranged in the above-described manner can properly generate a tone without overlapping a succeeding tone, so that a staccato performance is achieved as originally intended even after the swing processing. Further, even in the case of a succession of same-pitch notes, successive tones can be generated with no overlapping and they can be generated without respective attack portions being lost. Furthermore, because of the arrangement that the swing processing is applied to each even-numbered beat in performance data having n number of beats, the present invention can effectively prevent an unintended variation of the beats.

According to another aspect of the present invention, there is provided a tone generating device for generating tones on the basis of supplied performance data including at least data designating tone-generation start time and duration, which comprises: a tone-generation-start control section that starts tone generation of a note at timing specified by the data designating the tone-generation start time of the note; a duration control section that terminates the tone generation of the note when the tone generation of the note started via the tone-generation-start control section has lasted for a period specified by the data designating the duration of the note; and a number-of-note indicating section that, for each of a plurality of pitches, indicates a total number of notes being simultaneously sounded at the pitch. When tone generation of a note at a specific pitch is to be terminated, the duration control section decrements by one the total number of notes, for the specific pitch, indicated by the number-of-note indicating section and terminates tone generation of all the notes at the specific pitch once the decremented total number has reached zero. Thus, when a plurality of same-pitch notes are sounded, tone generation of that pitch can be terminated at key-off timing of one of the notes which is in a less-progressed tone generating stage than those of the others, because of the arrangement that the key-off operation is effected only when the number of to-be-sounded notes for that pitch has become zero.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
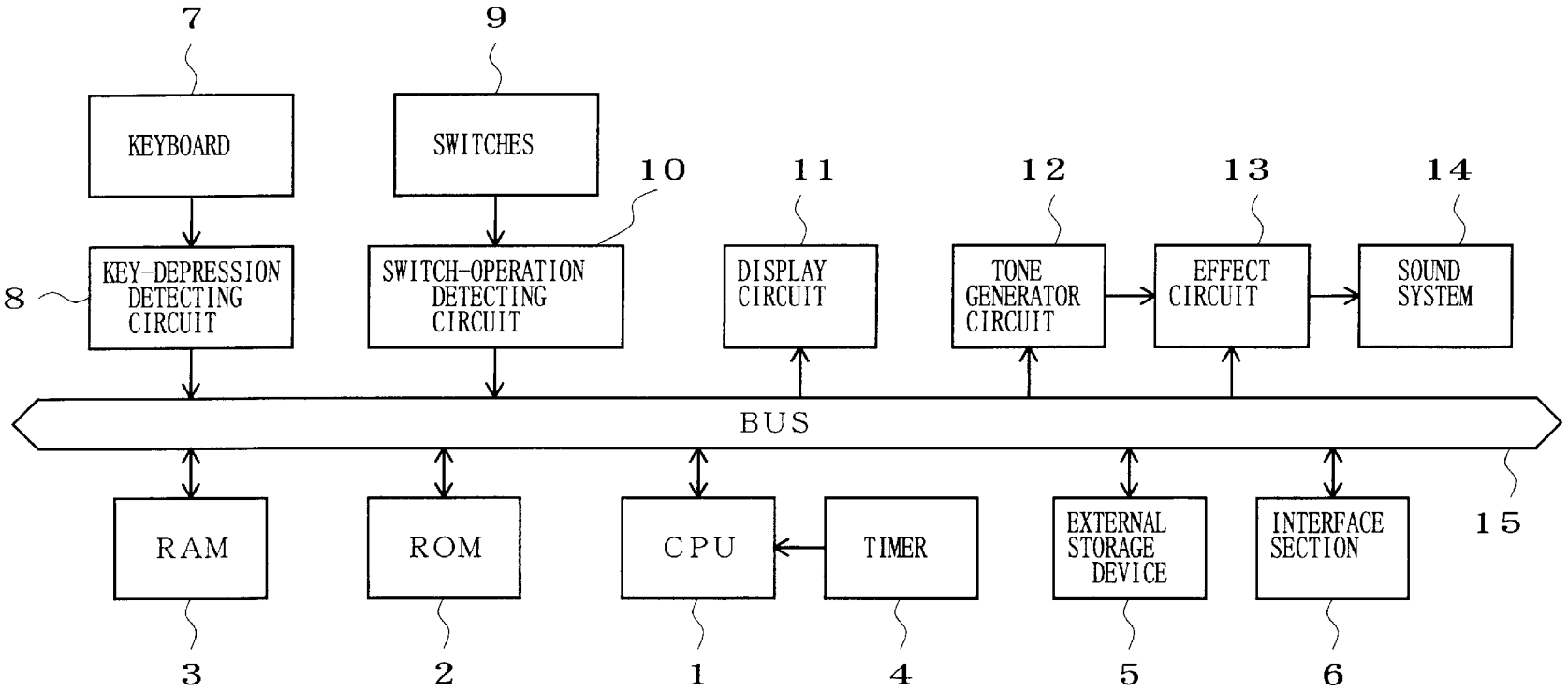
FIG. 1 is a block diagram showing an exemplary hardware setup of a tone generating device in accordance with a preferred embodiment of the present invention.

Referring first to FIG. 1, there is shown a tone generating device including a performance control unit in accordance with a preferred embodiment of the present invention. In this tone generating device, a microprocessor (CPU) 1 runs control programs to carry out various performance control such as swing processing as will be described in detail later. Read-only memory (ROM) 3 has prestored therein the control programs, swing processing program and the like to be executed by the CPU 1, and a random-access memory (RAM) 4 includes storage areas for storing performance data read out from an external storage device 5 and other data. The external storage device 5 operates to read out MIDI (Musical Instrument Digital Interface) performance data and other data from a recording medium installed therein and write onto the recording medium various data such as performance data having undergone performance control processing. The external storage device 5 may be a hard disk drive (HDD), floppy disk drive (FDD), CD (Compact Disk)-ROM drive or MO (Magneto Optical disk) drive. Reference numeral 4 represents a timer that issues signals indicative of timer interrupt timing to the CPU 1.

Interface section 6 may include a MIDI interface via which performance data such as MIDI event data are input to the tone generating device and MIDI event data generated in the device are output, a communication interface connected to a communication network such as a telephone line network, and other necessary interfaces. Musical performance keyboard for generating performance data is connected via a key-depression detecting circuit 8 to a bus 15, but it is not necessarily essential for the present invention and may be omitted. Reference numeral 9 represents various key switches of a personal computer, including keys of English and Japanese alphabets, numerals, signs, paragraph-change key and page-change key, or panel switches for setting various tone generating conditions. Switch-operation detecting circuit 10 detects activation of each of the keys 9.

Further, reference numeral 11 represents a display (monitor) circuit 11 for visually displaying thereon performance control parameters, on which lyric data may also be displayed. Tone generator circuit 12 receives performance data having undergone the swing processing (swing-processed performance data) from the RAM 3 and generates tone signals corresponding to the received performance data. Effect circuit 13 imparts a performance effect, such as reverberation or chorus, to the tone signals generated by the tone generator circuit 12. Reference numeral 14 represents a sound system that amplifies and audibly reproduces (sounds) each of the effect-imparted tone signals from the effect circuit 13.

The above-noted setup is similar to that of a general purpose personal computer or work station, and the tone generating device and method of the present invention may be implemented either by hardware using such a general-purpose device or by hardware arranged as a dedicated musical instrument. In the instant embodiment, the medium recording the programs characterizing the present invention is the ROM 2, RAM 3 or external storage device 5.

Figure 2:
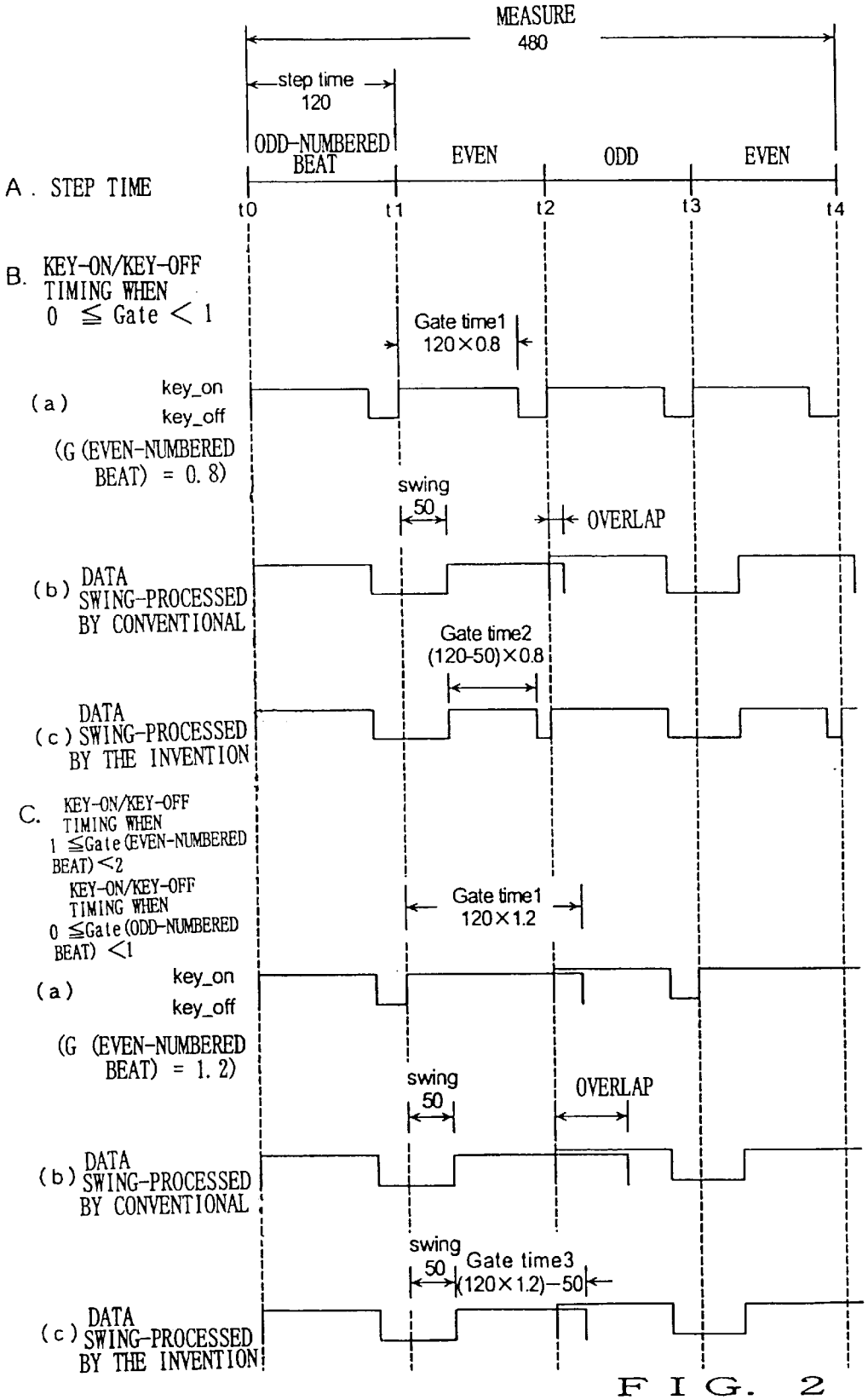
FIG. 2 is a diagram showing swing processing executed in the tone generating device of FIG. 1 in comparison with the conventional swing processing.

FIG. 2 is a diagram showing the swing processing executed in a tone control unit of the present invention in comparison with the conventional swing processing, and the following paragraphs describe the swing processing of the invention with reference to FIG. 2.

Item A in FIG. 2 shows a time of one measure, and a step time in the illustrated example corresponds to the length of a quarter note or 120 clock pulses. Thus, in this example, one measure corresponds to 480 clock pulses each representing interrupt timing of the timer 4.

Item B in FIG. 2 shows key-on and key-off timing in an example where the ratio of gate time of each of odd- and even-numbered beats to the step time (Gate) is chosen to be equivalent to or greater than "0" and smaller than "1" (i.e., $0 \leqq \text{Gate} < 1$). "(a)" of item A shows an example where the ratio of each even-numbered-beat gate time to the step time (Gate) is chosen to be "0.8" (G=0.8). At "(a)", performance data to be performed in staccato with no overlap of two successive tones are shown as a pulse waveform. In the pulse waveform, each of rising edge times t0, t1, t2 and t3 represents tone-generation start (key-on) timing, each of falling edge times represents tone-generation end (key-off) timing, and each tone-generation lasting period or duration from the key-on timing to the corresponding key-off timing is denoted as a gate time. Thus, where the ratio of each even-numbered-beat gate time to the step time (Gate) is chosen to be "0.8" (G=0.8), "Gate time 1" for the even-numbered-beat equals 96 clock pulses (120 clock pulses× 0.8).

At "(c)" of item B in FIG. 2, there are shown performance data obtained by subjecting the performance data shown at "(a)" to the swing processing executed by the tone control unit ("data swing-processed by the invention"). In the illustrated example, key-on timing of each even-numbered-beat note is delayed, through the swing processing, by a time corresponding to 50 clock pulses. Namely, the time corresponding to 50 clock pulses is set as the swing time, so that sounding of the even-numbered-beat note, which is originally set to start at time t1, is initiated 50 clock pulses after time t1. If the key-on timing is delayed as shown at "(b)" of item B, the corresponding key-off timing would also be delayed by the same amount with the conventional technique; to avoid this, the tone control unit of the present invention subtracts the swing time from the step time and multiplies the subtraction result (difference) by the ratio of the gate time to the step time (gate ratio), so as to set the multiplication result (product) as "Gate time 2" representative of a tone-generation lasting period or duration.

In the example shown at "(c)" of item B, the duration, "Gate time 2," equals 56 clock pulses (=(120−50) clock pulses×0.8). Thus, the key-off timing of the swing-processed even-numbered-beat note comes before key-on timing of a third (i.e., next odd-number)-beat note; therefore, the even-numbered-beat note is muted or deadened before the key-on timing of the third-beat note. As a consequence, the swing-processed even-numbered-beat note is prevented from being generated in overlapping relation to the next odd-number-beat note, so that staccato performance data can be performed in an appropriate staccato fashion even when they have been subjected to the swing processing.

Item C in FIG. 2 shows key-on and key-off timing in a situation where the ratio of the gate time of each odd-numbered beat to the step time (Gate) is chosen to be equivalent to or greater than "0" and smaller than "1" (i.e., $1 \leqq \text{Gate} < 1$) and the ratio of the gate time of each even-numbered beat to the step time (Gate) is chosen to be equivalent to or greater than "1" and smaller than "2" (i.e., $1 \leqq \text{Gate} \leqq 2$). "(a)" of item C shows an example where the ratio of the even-numbered-beat gate time to the step time (Gate) is chosen to be "1.2" (G=1.2). At "(a)", performance data to be performed in legato such that an even-number-beat tone overlaps a next odd-number-beat tone are shown as a pulse waveform. In the pulse waveform, each of rising edge times t0, t1, t2 and t3 represents tone-generation start (key-on) timing, each of falling edge times represents tone-generation end (key-off) timing, and the duration from the key-on timing to the corresponding key-off timing is denoted as a gate time. Thus, where the ratio of each even-numbered-beat gate time to the step time (Gate) is chosen to be "1.2" (G=1.2), "Gate time 1" for the even-numbered beat equals 144 clock pulses (120 clock pulses× 1.2).

At "(c)" of item C in FIG. 2, there are shown performance data obtained by subjecting the performance data shown at "(a)" to the swing processing by the tone control unit ("data swing-processed by the invention"). In the illustrated example, key-on timing of each even-numbered-beat note is shown as delayed, through the swing processing, by a time corresponding to 50 clock pulses. Namely, sounding of the even-numbered-beat note, which is originally set to start at time t1, is initiated 50 clock pulses after time t1. If the key-on timing is delayed by subjecting the even-numbered-beat note to the swing processing as shown at "(b)" of item C, the corresponding key-off timing would also be delayed by the same amount with the conventional technique; to avoid this, the tone control unit of the present invention subtracts the swing time from "Gate time 1" representing a tone-generation lasting period or duration of the swing-processed note, so as to set the subtraction result (difference) as "Gate time 3" representing a sounding duration for the even-numbered beat. Thus, in the example shown at (c) of item C, the duration for the even-numbered beat equals 94 clock pulses ((120×1.2)−50).

Thus, the key-off timing of the swing-processed even-numbered-beat note remains the same as before the swing processing; therefore, the swing-processed even-numbered-beat note is deadened at that key-off timing. As a consequence, the key-off timing of the swing-processed even-numbered-beat note is prevented from coming after the key-on timing of a next even-numbered-beat note (i.e., a second tone from the swing-processed even-numbered-beat note), and the swing-processed even-numbered-beat note can be prevented from being sounded in overlapping relation to the next even-numbered-beat note. In this way, a performance after the swing processing can be carried out as desired by a player without departing from player's intention.

Figures 3, 4:
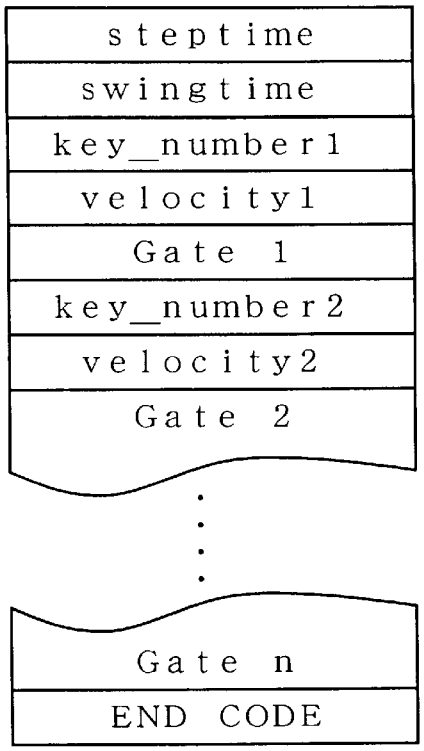
FIG. 3 is a diagram showing an exemplary organization of step sequence data used in the tone generating device of FIG. 1.
FIG. 4 is a diagram explanatory of an exemplary organization of a key-on/key-off management buffer in the tone generating device.

Referring now to FIG. 3, there is shown an exemplary organization of step sequence data which contains performance data and are stored in, for example, the RAM 3. Step time data ("steptime") in the step sequence data of FIG. 3 is a parameter that can be set optionally by the user. In the illustrated example of FIG. 2, the step time is chosen to be the length of a quarter note that corresponds to 120 clock pulses as stated earlier, so that tone generation is executed once for every 120 clock pulses. Swing time data ("swingtime") to impart a feeling of swing to a music piece can also be set optionally by the user and is chosen to be 50 clock pulses in the illustrated example of FIG. 2. According to the organization of FIG. 3, each note is represented by a set of three note-relating data: key number data ("key_number") indicative of a pitch; velocity data (velocity) indicative of a key depression speed, i.e., tone volume; and gate data ("Gate") indicative of a tone-generation lasting period or duration of the note. For example, a particular number of sets of such three note-relating data are stored for the corresponding number of notes constituting a measure. After the sets of note-relating data is stored an end code indicative of the end of the performance data.

In the illustrated organization of the step sequence data, the vertical axis represents addresses of the memory, and the tone generating device is designed to perform a desired music piece by sequentially advancing the memory address to read out the step sequence data. In this case, the step sequence data comprises the note-relating data covering, for example, one measure, and the step time and swing time can be set optionally by the user.

For execution of a music performance, a read pointer is first set to point to the address location of the step time data, so as to start the sequential data readout at the step time data. Tone generation timing is set, in terms of a specific number of clock pulses, in accordance with read-out step time data, and then a swing time to delay tone generation at each even-numbered beat is set in accordance with read-out swing time data.

After that, three note-relating data for a first note in the measure: key number data (key_number 1); velocity data (velocity 1); and gate data (Gate 1) are read out. Key-on timing of the first note is set to come at time t0 shown in item A of FIG. 2, so that the key number data (key_number 1) and velocity data (velocity 1) are sent to the tone generator circuit 12 at that key-on timing. The tone generator circuit 12 operates to sound the first note in response to the key number data and velocity data. Key-off timing of the note is a time point, represented by the gate data (Gate 1), after the key-on timing. At that key-off timing, a key-off signal is sent to the tone generator circuit 12 so that the circuit 12 executes a predetermined operation to deaden or mute the first note. The gate data is represented in terms of, for example, its ratio to the step time data; in the illustrated example of FIG. 2, the gate data is 0.8 for a staccato performance and 1.2 for a legato performance.

Then, key number data (key_number 2), velocity data (velocity 2) and gate data (Gate 2) for a second note in the measure are read out. Although key-on timing of the second note is set to come at time t1 shown in item A of FIG. 2, the note is subjected to the swing processing because it is an even-numbered note in the measure. If the swing time is set to equal 50 clock pulses, the key number data (key_number 2) and velocity data (velocity 2) are sent to the tone generator circuit 12 upon lapse of 50 clock pulses from time t1, and the tone generator circuit 12 sounds the second note in response to the key number data and velocity data.

Further, if the ratio of the gate data (Gate 2) to the step time data is set to 0.8, then the second note is determined as being of a staccato performance, and a duration of the second note is calculated using the following equation:

Duration=(Step Time Data−Swing Time)×Gate Data=(120−50)×0.8=56 Clock Pulses

Thus, once a duration equal to 56 clock pulses has elapsed from the key-on timing, a key-off signal is sent to the tone generator circuit 12 to effect deadening of the second note (see (c) in item B of FIG. 2). In this way, the sounding of the second note is caused to terminate prior to time t2 which is key-on timing of a third note in the measure, so that the note to be performed in staccato can be prevented from being performed in legato and from losing an attack feeling.

Afterward, the third note, fourth note, . . . , n-th note are sequentially read out and subjected to the swing processing as described above. Then, once the end code is read out, the read pointer is moved back to the location of the key number data of the first note so that the first to nth notes are repetitively read out in cycles for audible reproduction after having been subjected to the swing processing.

For a legato performance, the gate data is set to 1.2, and the CPU 1 determines a specific note in question as being of a legato performance when the gate data is equivalent to or greater than 1. The swing processing delays the key-on timing of the specific note in the above-mentioned manner, and a duration of the note is calculated using the following equation:

Duration=(Step Time Data×Gate Data)−Swing Time=(120×1.2)−50=94 Clock Pulses

Thus, once a duration equal to 94 clock pulses has elapsed from the key-on timing, a key-off signal is sent to the tone generator circuit 12 to effect deadening of the note in question (see (c) in item C of FIG. 2). In this way, the original key-off timing of the note in question remains unchanged even after the swing processing and the sounding of the note is, without fail, caused to terminate before key-on timing of a second note from the current note, so that the second note to be performed in staccato can be prevented from being performed in legato and from losing an attack feeling.

Thus, as long as the gate data is expressed in terms of its ratio to the step time data, the tone generating device of the present invention can determine whether the note is to be performed in staccato or legato, by determining whether the gate data is smaller than "1" or equivalent to or greater than "1". In accordance with such a determination, the tone generating device varies the manner of executing the swing processing between staccato and legato performances.

Figure 9A:
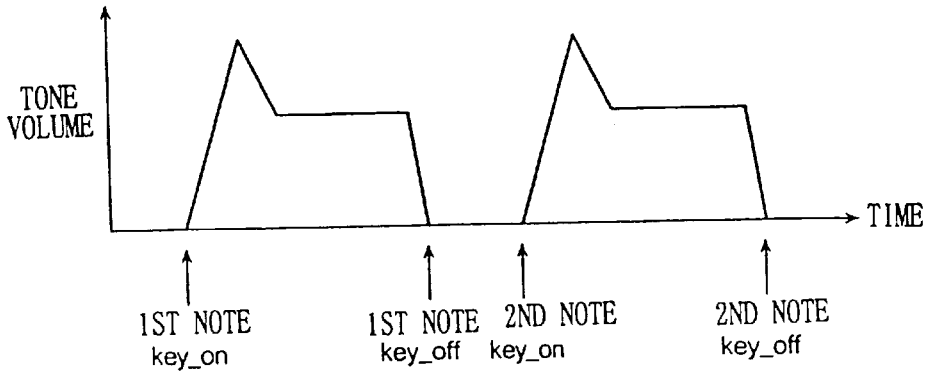
PRIOR ART FIG. 9A
FIGS. 9A and 9B are diagrams explanatory of conventional swing processing.
Figure 9B:
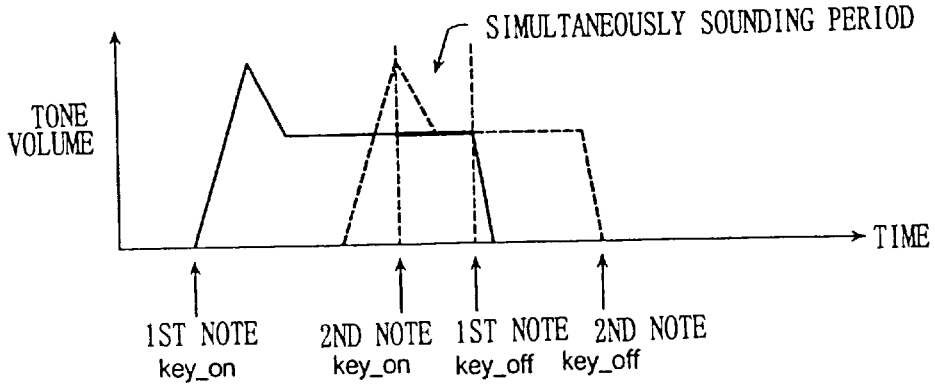
FIG. 9B PRIOR ART

Incidentally, same-pitch notes may sometimes successively appear in performance data to be performed in legato, in which case key number data and velocity data of the successive notes are sent to the tone generator circuit 12 at the respective key-on timing. Because the gate data of a leading one of the successive notes to be performed in legato is greater than "1", a time occurs when tones are generated at a same pitch as shown in FIG. 9B. Thus, once a key-off signal is sent to the tone generator circuit 12 upon lapse of the of the leading note, the key-off or tone deadening operation, which is normally carried out on each note of a designated pitch, is performed on the leading and second notes. As a consequence, tone generation of the second note would be undesirably terminated simultaneously with that of the leading note.

The tone generating device of the present invention avoids such an inconvenience by providing a key-on/key-off management buffer as shown in FIG. 4. The key-on/key-off management buffer is provided in an area of the RAM 3, where the number of notes to be sounded is stored for each key number (key_number) or pitch. In FIG. 4, the key-on/key-off management buffer is shown as storing the numbers of to-be-sounded notes for 128 different key numbers "0" to "127"; for example, the number of to-be-sounded notes for key number "2" is "1", and the number of to-be-sounded notes for key number "4" is "2" which indicates that two tones of key number "4" are to be generated simultaneously. Note that the number of to-be-sounded notes is incremented by one upon arrival of key-on timing while it is decremented by one upon arrival of key-off timing.

Namely, each time key-off timing of a specific key number arrives, the CPU 1 of the tone generating device refers to the key-on/key-off management buffer to find the current number of to-be-sounded notes for the specific key number. If the current number of to-be-sounded notes for the specific key number exceeds "1", it is decremented by one without a key-off signal being sent to the tone generator circuit 12. If the current number of to-be-sounded notes for the specific key number is "1", it is decremented by one to take a value "0" and then a key-off signal is sent to the tone generator circuit 12 to effect the tone deadening operation. With this arrangement, it is possible to avoid the inconvenience that all of the same-pitch notes are deadened together at the same time in response to key-off timing of the leading one of the notes during simultaneous sounding of the notes.

Now, with reference to flowcharts of FIGS. 5 to 8, a description will be made about an exemplary step sequence of the swing processing carried out by the performance control unit.

Figure 5:
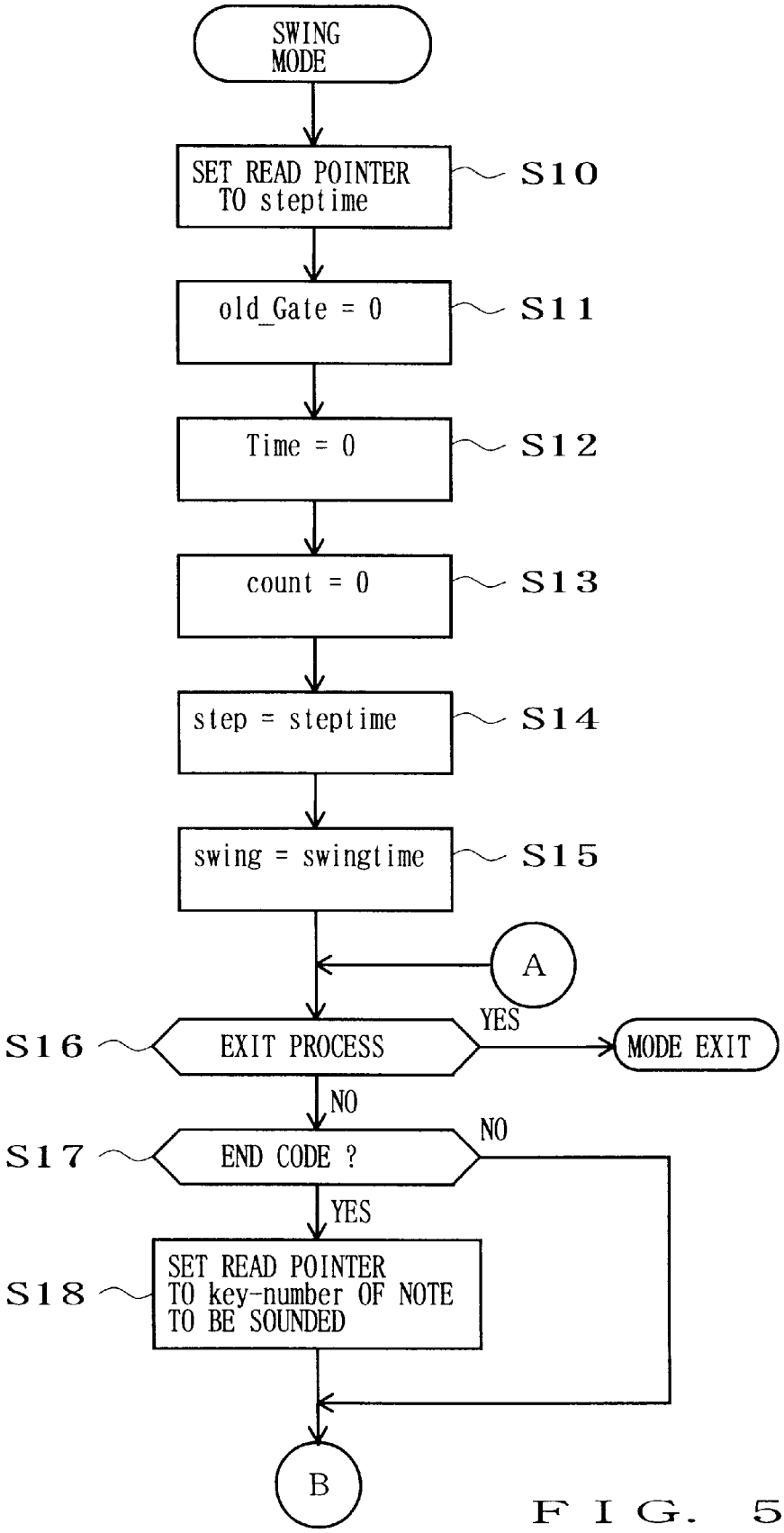
FIG. 5 is a flowchart showing a part of swing processing carried out in the tone generating device.

In FIG. 5, the swing processing is triggered when the tone generating device is placed in a swing mode in response to an instruction to execute the swing processing. At step S10, the read pointer, for indicating where data readout is to be initiated, is set to point to the address location of step time data shown in FIG. 3 so that the step time data is first read out. At next step S11, an old gate register is reset to "0" (old_Gate=0). Value stored in this old gate register is representative of a difference between the lengths of the duration and step time of the note in question.

Then, a time register ("Time") that indicates an elapsed time in terms of a current count of the clock pulses is reset to "0" at step S12 and a count register ("count") that indicates whether a current beat is an odd-numbered or even-numbered beat is reset to "0" at step S13, so that various operations are then performed on a first odd-numbered-beat note (first note in the measure). Further, the read-out step time data is stored into a step register ("step") at step S14, and swing time data next pointed to by the read pointer is read out and stored into a swing register ("swing") at step S15. Then, at step S16, a determination is made as to whether there has been given an instruction to execute an exit process for terminating the swing processing. Because no such instruction is given at a stage immediately after the initiation of the swing processing, a negative (NO) determination is made at step S16 and control proceeds to step S17, where a further determination is made as to whether or not next data is an end code. Because the step sequence data contain a plurality of performance data as shown in FIG. 3, such an end code is not read out at the stage immediately after the initiation of the swing processing, so that a negative (NO) determination is made at step S17 and control jumps to step S20 of FIG. 6 via connecting point B.

When termination of the swing processing is instructed, an affirmative (YES) determination is made at step S16 and the tone generating device is placed in an exit mode. When the end code is read out, an affirmative (YES) determination is made at step S17 and control proceeds to step S18, where the read pointer is set to point to key number data of the first note shown in FIG. 3 so that the key number data is read out.

Figure 6:
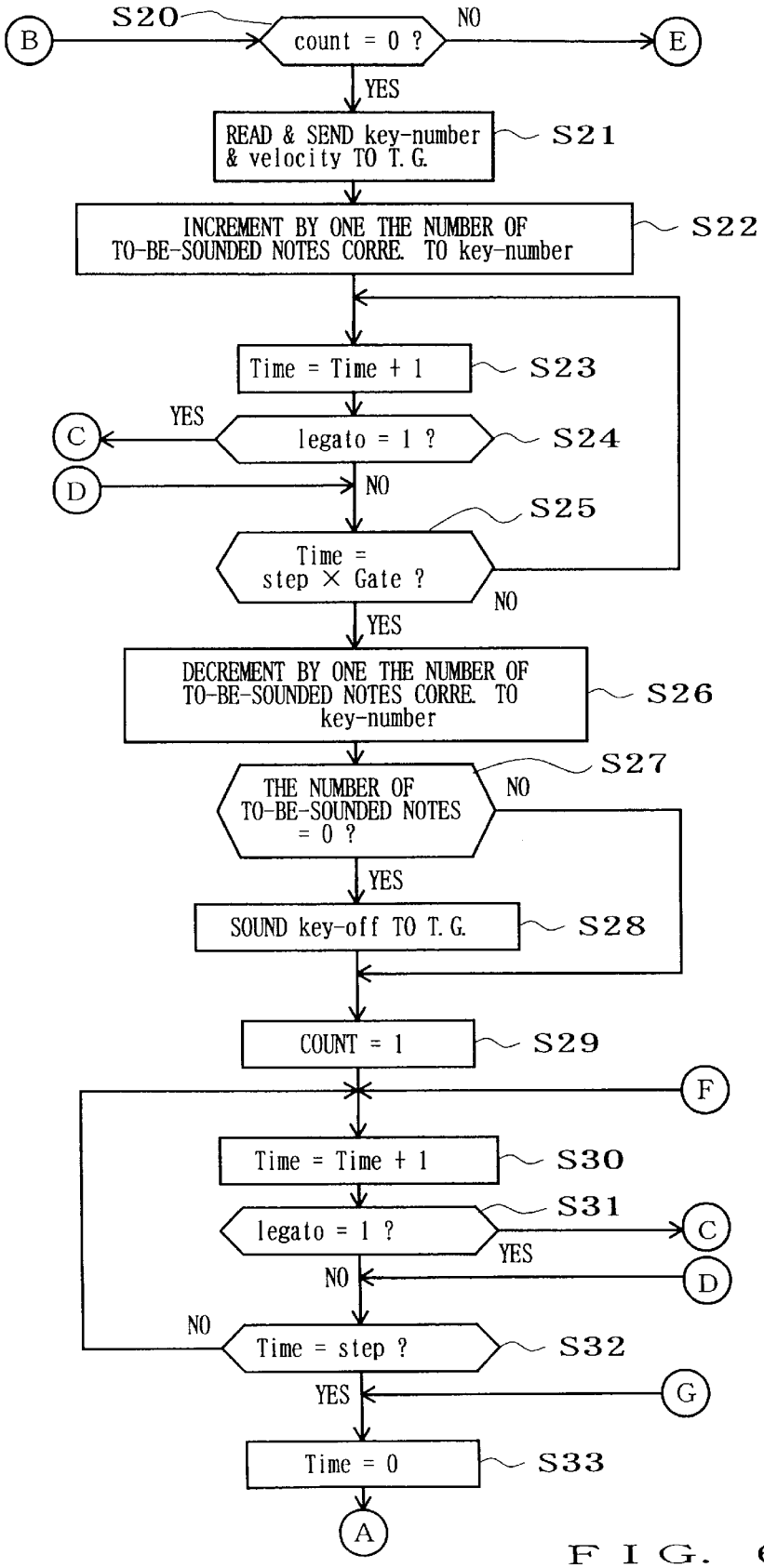
FIG. 6 is a flowchart showing another part of the swing processing.
Figure 7:
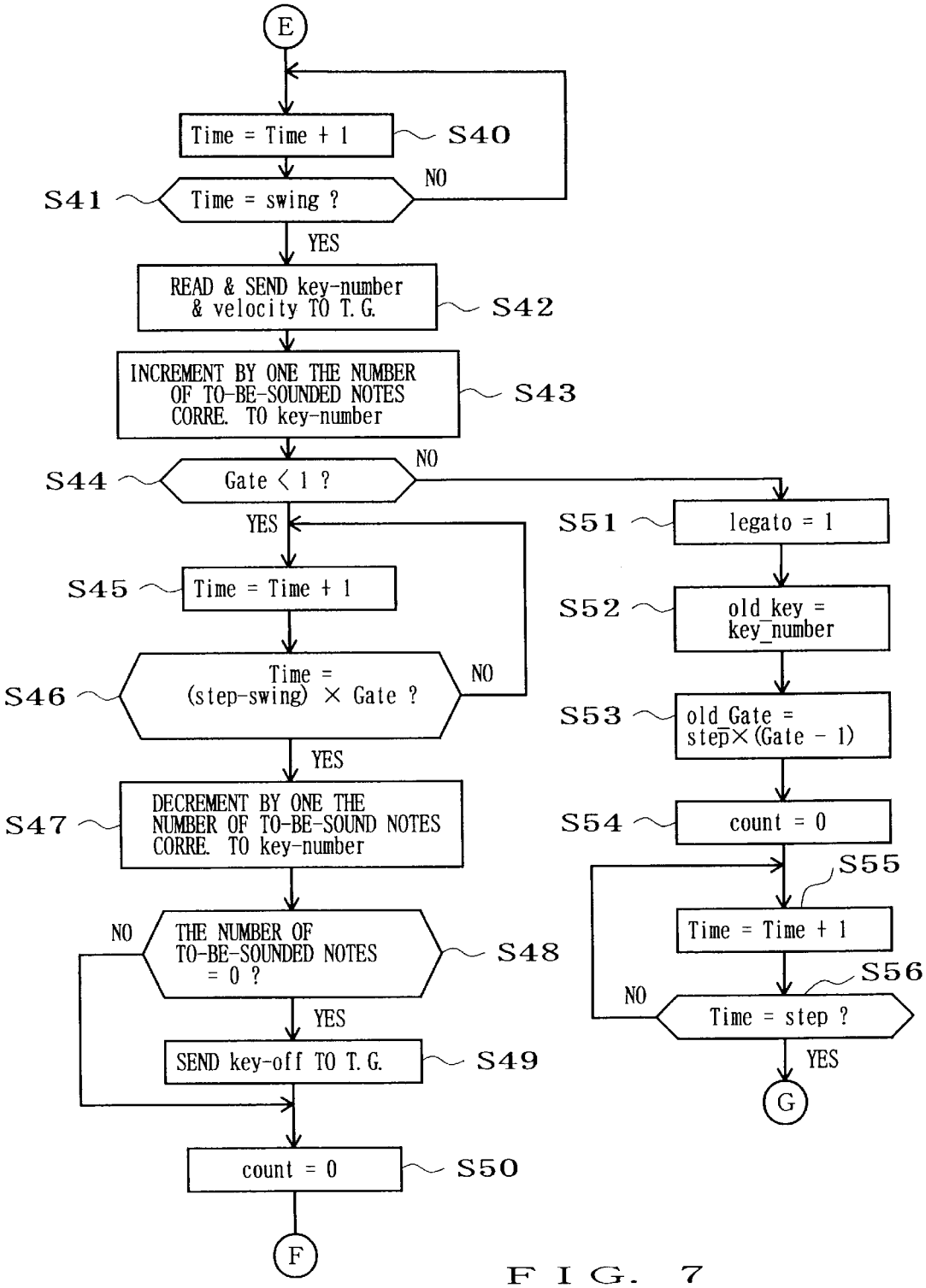
FIG. 7 is a flowchart showing still another part of the swing processing.
Figure 8:
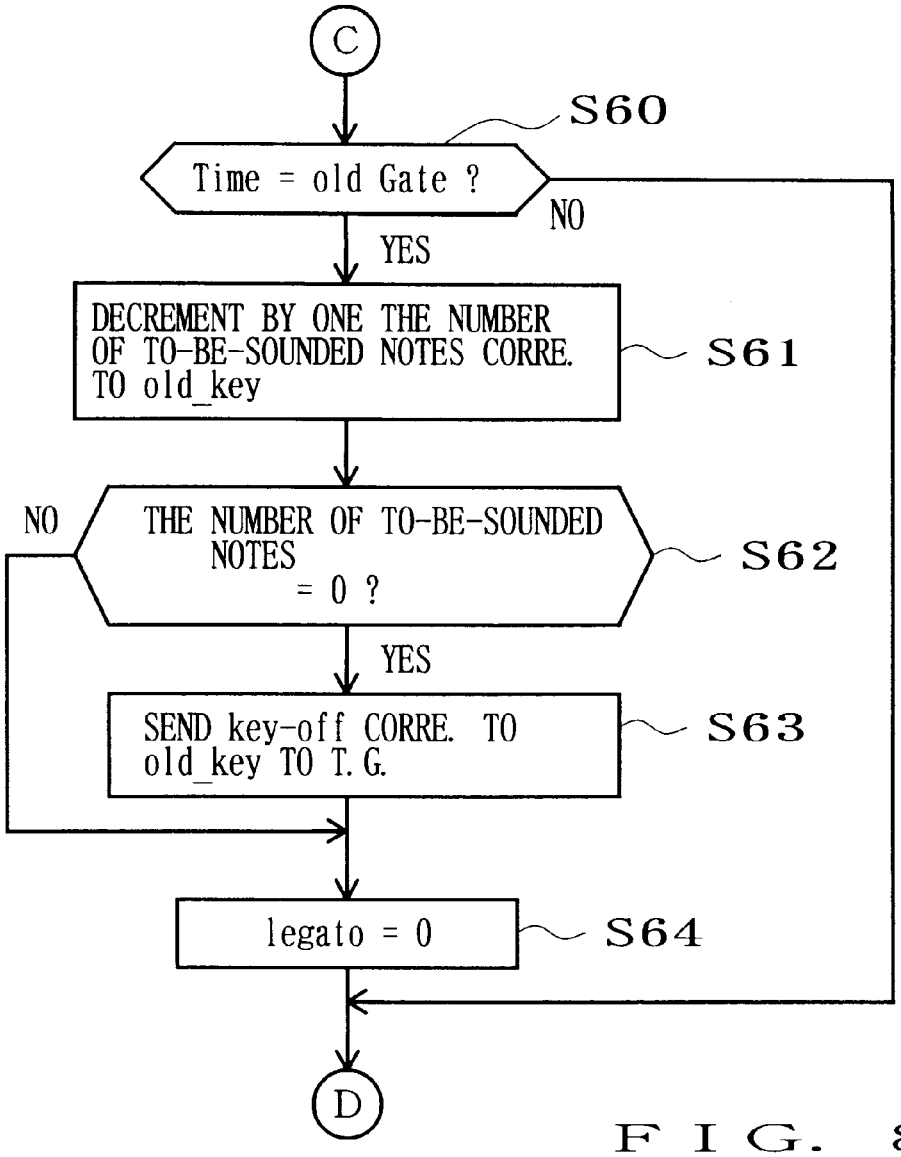
FIG. 8 is a flowchart showing the remaining part of the swing processing.

At step S20 of FIG. 6, it is determined whether or not the current stored value of the count register is "0". Now that the count register has been reset to "0" at step S13, an affirmative (YES) determination is made at step S20 and thus control proceeds to step S21, where key number data and velocity data of the first odd-numbered-beat note are read out and sent to the tone generator circuit (T.G.) 12. In response to the key number data and velocity data, the tone generator circuit 12 generates a tone waveform corresponding to the first note, which is audibly reproduced through the sound system 14 after being imparted a selected tonal effect by the effect circuit 13.

At next step S22, the number of to-be-sounded notes, stored in the key-on/key-off management buffer, corresponding to the key number read out at step S21 is incremented by one; in this case, the number of to-be-sounded notes becomes "1" because the current note is the first one in the step sequence data. Then, the value of the time register is incremented by one, and control moves on to step S24 to determine whether or not a legato register currently stores a value "1" indicating that the current note is to be performed in legato. If the stored value of the legato register is smaller than "1" and indicates that the current note is not to be performed in legato, a negative determination is made at step S24, and control proceeds to step S25. At step S25, a determination is made as to whether the duration of the first note has terminated, by checking whether gate time data obtained by multiplying the stored step time data in the step register by the gate data is coincident with the stored value in the time register.

At an initial stage of the tone generation, the stored value in the time register is too small and does not coincide with the gate time data, so that a negative determination is made at step S25. In response to the negative determination at step S25, control loops back to step S23 so that the operations of steps S23 to S25 are repetitively executed until coincidence is detected between the gate time data and the value of the time register incremented every clock cycle. When the value of the time register becomes coincident with the gate time data, it means that the duration of the first note has elapsed, and thus an affirmative determination is made at step S25. In response to the affirmative determination at step S25, control moves on to step S26, where the number of to-be-sounded notes for the currently sounded key number is decremented by one. After that, a determination is made at step S27 as to whether or not the number of to-be-sounded notes for the currently sounded key number is now "0".

If the number of to-be-sounded notes for the currently sounded key number is "0" as determined at step S27, a key-off signal is sent to the tone generator circuit 12 at step S28 so that the circuit 12 performs a predetermined tone deadening operation on that key number. If the number of to-be-sounded notes for the currently sounded key number is not "0", the operation of step S28 is skipped and hence no tone deadening operation is performed on the key number.

The above-described is the swing processing for odd-numbered beats, where the key-on timing of each of the odd-numbered beats is set directly, i.e., with no delay, as an initial or start point of a step time.

Following step S28, the count register is set to a value "1" at step S29, so that the swing processing is then performed on an even-numbered-beat note at a next step time. The value of the time register is incremented by one at step S30, and control moves on to step S31, where it is determined whether or not a legato has been instructed for the preceding odd-numbered beat. In this case, a negative determination is made at step S31, and control goes to next step S32, where a determination is made as to whether the step time of the preceding odd-numbered beat has elapsed, by checking whether the step time data stored in the step register is coincident with the value stored in the time register. If the stored value in the time register is too small and does not coincide with the step time data, then a negative determination is made at step S32, so that the operations of steps S30 to S32 are repetitively executed until coincidence is detected between the step time data and the value of the time register incremented every clock cycle. When the value of the time register becomes coincident with the step time data, it means that the step time of the preceding odd-numbered beat has elapsed, and thus an affirmative determination is made at step S32. In response to the affirmative determination at step S32, control moves on to step S33 to reset the time register to "0" indicating arrival at start timing of a step time of a next even-numbered beat.

After step S33, control reverts to step S16 of FIG. 5 via connecting point A, so as to carry out the swing processing operations at and after step S16 for the next even-numbered beat note (i.e., second note). In the swing processing for the even-numbered beat note, the read pointer is set, at step S18, to point to key number data of the second note for readout of the key number data. At next step S20 of FIG. 6, it is determined whether or not the current stored value of the count register is "0". Now that the count register has been set to "1" at step S29, a negative determination is made at step S20 and thus control branches to step S40 of FIG. 7 via connecting point E.

The value stored in the time register is incremented by "1" at step S40, and then a determination is made at step S41 whether or not the incremented value of the time register is coincident with the value set into the swing register at step S15. The operation of incrementing the value of the time register every clock cycle at step S40 is repeated until coincidence is detected between the time register value and the swing register value. Upon detection of the coincidence, control proceeds to step S42, where key number data and velocity data of the even-numbered-beat note (second note) are read out and sent to the tone generator circuit 12. In response to the key number data and velocity data, the tone generator circuit 12 generates a tone waveform corresponding to the second note, which is then audibly reproduced through the sound system 14 after being imparted a selected tonal effect by the effect circuit 13. Through these operations, the key-on timing of the even-numbered-beat note is delayed by a time represented by the swing time data.

At step S43, the number of to-be-sounded notes, stored in the key-on/key-off management buffer, corresponding to the key number read out at step S42 is incremented by one. Then, it is determined at step S44 whether or not the gate data is smaller than "1" to see whether a legato has been instructed. If a legato has not been instructed and the gate data is smaller than "1", an affirmative determination is made at step S44, and control proceeds to step S45 in order to decrement the value of the time register by one. At next step S46, the swing time stored in the swing time register is subtracted from the step time stored in the step register and a determination is made as to whether gate time data obtained by multiplying the subtraction result by the gate data is coincident with the stored value in the time register, to thereby determine whether the duration of the second note has elapsed.

At an initial stage of the tone generation, the stored value in the time register is too small and does not coincide with the gate time data, so that a negative determination is made at step S46. In response to the negative determination at step S46, control loops back to step S45 so that the operations of steps S45 to S46 are repetitively executed until coincidence is detected between the gate time data and the value of the time register. When the value of the time register becomes coincident with the gate time data, it means that the duration of the second note has elapsed, and thus an affirmative determination is made at step S46. In response to the affirmative determination at step S46, control moves on to step S47, where the number of to-be-sounded notes for the currently sounded key number is decremented by one. After that, a further determination is made at step S48 as to whether or not the number of to-be-sounded notes for the currently sounded key number is now "0".

If the number of to-be-sounded notes is "0" as determined at step S48, it means that there is no more note for which tone generation is to be continued, and thus a key-off signal is sent at step S49 to the tone generator circuit 12 so that the circuit 12 executes the predetermined tone deadening operation for the currently sounded key number. If, on the other hand, the number of to-be-sounded notes is other than "0" as determined at step S48, it means that there is still one or more notes for which tone generation is to be continued, the operation of step S49 is skipped and no tone deadening operation is executed for the currently sounded key number.

The above-described is the swing processing for even-numbered beats for which a legato is not instructed, where the key-on timing of each of the even-numbered beats is delayed behind the start point of the step time by a time represented by the swing time data; thus, this processing can produce a feeling of swing. Subsequently, at step S50, the count register is reset to "0", so that control reverts to step S30 of FIG. 6, via connecting point F, in order to execute the operations at and after step S30 are carried out on a next odd-number-beat note (i.e., third note).

In the event that the second note is to be performed in legato, a negative determination is made at step S44 and thus control branches to step S51, where "1" is set into the legato register. Following this, key number data read out at step S42 is stored into an old key register (old_key) at step S52. Further, at next step S53, the step time data stored in the step register is multiplied by a value obtained by subtracting "1" from the gate data, and the multiplication result is stored into the old gate register. The value thus stored in the old gate register becomes tone data that is to be sounded in a next step time beyond the step time of the note. Then, at step S54, the count register is reset to "0", so that the swing processing will be executed on the odd-numbered beat note in the third step time.

The value of the time register is incremented by one at step S55, and control moves on to step S56, where a determination is made as to whether the step time of the even-numbered beat having undergone the step processing has elapsed, by checking whether the step time data stored in the step register is coincident with the value stored in the time register. If the stored value in the time register is too small and does not coincide with the step time data, then a negative determination is made at step S56 and control loops back to step S55, so that the operations of steps S55 to S56 are repetitively executed until coincidence is detected between the step time data and the value of the time register incremented every clock cycle. When the value of the time register becomes coincident with the step time data, it means that the second step time has elapsed, and thus an affirmative determination is made at step S56. In response to the affirmative determination at step S56, control moves on to step S33, via connecting point G, to reset the time register to "0" indicating arrival at the start point of a step time of a next odd-numbered beat.

After step S33, control reverts to step S16 of FIG. 5 via connecting point A, so as to carry out the swing processing at and after step S16 for the odd-numbered beat note. If a legato has been instructed in the swing processing for the preceding even-numbered beat, an affirmative determination is made as step S24 now that "1" has been set in the legato register, so that control branches via connecting point C to step S60 of FIG. 8. At step S60, it is determined whether or not the values stored in the old gate register and time register are coincident with each other. If no coincidence is detected at step S60, control branches via connecting point D back to step S25. At step S25, a determination is made as to whether the duration of the current odd-number beat has elapsed. With a negative answer at step S25, control loops back to step S23 in order to increment the value of the time register. Then, control branches from step S24, via connecting point D, to step S60, where it is again determined whether or not the values stored in the old gate register and time register are coincident with each other. Namely, the operations of steps S23, S24, S60 and S25, including the one to increment the value of the time register, are repeated until coincidence is detected between the values stored in the old gate register and time register.

The values stored in the old gate register and time register are determined to be coincident with each other at step S60, only when the duration of the preceding even-numbered beat for which a legato is instructed has elapsed. With the affirmative determination at step S60, control moves on to step S61, where the number of to-be-sounded notes, stored in the key-on/key-off management buffer, corresponding to the key number data of the preceding even-numbered beat is decremented by one. After that, a determination is made at step S62 as to whether or not the number of to-be-sounded notes for that key number is now "0". If the number of to-be-sounded notes is "0" as determined at step S62, a key-off signal corresponding to a particular pitch or key number of the preceding even-numbered beat is sent to the tone generator circuit 12 at step S63 so that the circuit 12 performs the tone deadening operation on the tone of the particular pitch. Then, the legato register is reset to "0" at step S64, and control reverts to step S25 via connecting point D. If the number of to-be-sounded notes number is not "0" as determined at step S62, the operation of step S63 is skipped and hence no tone deadening operation is performed on the tone of the particular pitch.

Further, in the event that the time value stored in the old gate register is greater than the time value stored in the time register, an affirmative determination is made at step S25 before the determination is made in the affirmative at step S60; in this case, the determination at step S31, following the operations at and after step S26, is made in the affirmative, so that control branches to step S60 via connecting point C to execute the above-described operations at and after step S60. Namely, the operations of steps S30, S31, S60 and S32, including the one to increment the value of the time register, are repeated until coincidence is detected between the values stored in the old gate register and time register. Upon detection of the coincidence, a key-off signal is sent to the tone generator circuit 12 unless a plurality of tones of a same pitch are being generated.

By the above-described swing processing for odd-numbered beats and for even-numbered beats being repeated in an alternate fashion on the step sequence data of FIG. 3, tones can be generated with a feeling of swing. Then, once the swing processing reaches last data, i.e., end code, in the step sequence data, an affirmative determination is made at step S17, and thus the read pointer is set, at step S18, to point to the address of the key number data that is the leading data in the step sequence data, so that the step sequence data is then be repetitively read out to permit continued execution of the swing processing. The swing processing will be continued until the EXIT process is executed by way of step S16 in response entry of an instruction to terminate the processing.

Although the gate time has been described above as being a ratio to the step time, the present invention is not so limited, and the gate time may be expressed as an actual value such as the number of clock pulses. In such a case, the ratio of the gate time to the step time may be calculated, and the calculated result may be used as gate time data in the swing processing.

Further, whereas the step time and swing time have been described as being written as fixed values at the head of the step sequence data, the swing time may be varied during execution of the swing processing; for this purpose, the swing time may be input in real time using particular keys or operators, may be sequentially read out from among swing time data prestored in a time series, or may be varied using a predetermined function.

Furthermore, whereas the step sequence data have been described above as covering only a single measure and the step time as equalling the length of a quarter note, the step sequence data may cover two or more measures and the step time may be increased or decreased in notes. Moreover, whereas the length of a quarter note has been described as corresponding to 120 clock pulses and one measure as corresponding to 480 clock pulses, they may be chosen to correspond to smaller or greater numbers of clock pulses.

Furthermore, the performance data may be expressed as event-by-event timing, in which case values of the step time and gate time determined from intervals between the events may be used in the swing processing.

In addition, the number of pitches stored in the key-on/key-off management buffer, which manages the number of to-be-sounded notes for each pitch, may be other than 127.

Although the ratio of the gate time for each odd-numbered beat is chosen to be smaller than "1" in the above-described embodiment, it may be equivalent to or greater than "1" as long as it does not exceed "2" (i.e., $1 \leqq \text{Gate} \leqq 2$), in which case legato-related operations may be executed in the swing processing for each odd-numbered beat in a similar manner to the swing processing for even-numbered beats.

Moreover, a plurality of tones may be generated simultaneously although the embodiment has been described and flowcharted as generating a single tone at a time. In this case, the performance data may contain data designating a specific number of notes to be simultaneously sounded, or a specific number of key numbers may be arranged in the performance data in corresponding relation to the number of notes to be simultaneously sounded.

It should also be noted that the time register ("Time") has been described as being reset each time a note is sounded, the reset timing of the time register may be varied in consideration of the situation where the stored step sequence data contain event-by-event timing values.

Incidentally, as described above and flowcharted, the preferred embodiment is arranged in such a manner that once an end code is read out, the read pointer is moved back to the head of the sequence data for repeated readout of the sequence data. Namely, where the step sequence data consists of four beats (beat 1, beat 2, beat 3 and beat 4), the swing processing is applied to the four beats in order of "beat 1, beat 2, beat 3, beat 4, beat 1, beat 2, beat 3, beat 4, beat 1, beat 2, . . . "; in this case, key-on timing of the even-numbered beats, 2nd and 4th beats, is delayed by the swing time. However, according to the principle of the present invention, the order in which the beats are read out from among the step sequence data may be other than the above-mentioned, such as "beat 1, beat 2, beat 3, beat 4, beat 4, beat 3, beat 2, beat 1, beat 1, beat 2, . . . " or "beat 1, beat 2, beat 3, beat 4, beat 3, beat 2, beat 1, beat 2, beat 3, . . . ".

Further, where the step sequence data consists of three beats and the readout order is "beat 1, beat 2, beat 3, beat 3, beat 2, beat 1, beat 1, beat 2, beat 3, . . . ", key-on timing of every second beat (i.e., beat 2, beat 3, beat 1, beat 2, . . . ) is delayed by a swing time, with the result that the sequence data originally having three beats would undesirably come to have six beats. Similarly, step sequence data originally having nine beats would come to have 18 beats. To avoid such an unwanted beat variation, the present invention operates to switch swing-processed positions such that, for example, only "beat 2" in the above-mentioned readout order is delayed; that is, if the delayed beats are shown in parentheses, "beat 2" in the above-mentioned readout order "beat 1, (beat 2), beat 3, beat 3, (beat 2), beat 1, beat 1, (beat 2), beat 3, . . . ".

The present invention may be embodied as a personal computer running application software rather than a dedicated tone generating device, in which case the application software prestored on a recording medium, such as a magnetic disk, optical disk and semiconductor memory, may be supplied to the personal computer directly or via a communication network. Further, any other type of electronic musical instrument than the keyboard-type instrument, such as a stringed instrument, wind instrument or percussion instrument, may be employed to generate a tone in the tone generating device of the present invention. Further, the present invention may be embodied as, rather than the integrated-type tone generating device containing a tone generator and automatic accompaniment device as described, a discrete-type tone generating device where a tone generator module and sequencer provided separately from each other are connected such as via MIDI and/or network communication means; in this case, the tone generating device may be in the form of an automatic performance piano.

The performance data used in the tone generating device of the present invention may be in any desired format such as: the "event plus relative time" format where an occurrence time of each performance event is expressed by an elapsed time from a preceding event; the "event plus absolute time" format where an occurrence time of each performance event is expressed by an absolute time within a music piece or measure; the "pitch (rest) plus note length" format where performance data is expressed by a combination of pitch and length of a note or by a combination of rest and its length; and the so-called "solid" format where a memory location is allocated for each minimum resolution unit of a performance and each performance event is stored at one of the memory locations corresponding to an occurrence time of the event.

Furthermore, an automatic performance tempo may be changed in any desired manner; for example, it may be changed by varying a tempo clock (interrupt signal) frequency, modifying a timing data value while maintaining a constant tempo clock frequency or varying a value used to count timing data per operation.

The accompaniment pattern data may be in a format where data for a plurality of channels are stored together in a mixed condition or in a format where data for each channel is stored in a separate track.

Hard disk drive (HDD), one form of the external storage device 5, serves to store the control programs and various necessary data. The control programs may be prestored in a hard disk installed within the hard disk drive rather than in the ROM 2, in which case, by just loading the control programs from the hard disk into the RAM 3, the CPU 1 can operate in exactly the same way as where the control programs are stored in the ROM 2. This alternative arrangement using the hard disk will greatly facilitate version-up of the control programs, addition of a new control program and the like.

CD-ROM drive is another form the external storage device 5, and it reads out the control programs and various data from a CD-ROM installed therein and the read-out control programs and data are then stored into the hard disk within the hard disk device. This alternative arrangement using the CD-ROM will also greatly facilitate version-up of the control programs, addition of a new control programs and the like.

Any other device than the above-mentioned may be employed as the external storage device 5, such as a floppy disk drive or magneto-optical disk drive.

Furthermore, by employing a communication interface as the interface 6, the tone generating device of the present invention can be connected to a communication network, such as a LAN (Local Area Network), Internet and telephone line network, via which it can be connected with a server computer. Thus, where the control programs and various data are not stored in the hard disk, these programs and data may be downloaded from the server computer. In such a case, the tone generating device of the invention, as a "client", sends a command requesting the server computer to download the programs and data by way of the communication interface and communication network. In response to the command, the server computer delivers the requested control programs and data to the tone generating device via the communication network, and the tone generating device, in turn, receives and stores the control programs and data into the external storage device 5, such as the hard disk device, to complete the downloading of the programs and data.

In summary, even when the swing processing is applied to performance data to be performed in staccato, the present invention arranged in the above-described manner can properly generate a tone without overlapping a succeeding tone, so that a staccato performance can be maintained even after the swing processing. Further, even in the case of a succession of same-pitch notes, no overlapping of successive tones occurs and they can be generated without respective attack portions being lost.

Furthermore, because of the arrangement that the swing processing is applied to each even-numbered beat in performance data having n number of beats, the present invention can effectively prevent an unintended variation of the beats.

In addition, when a plurality of same-pitch notes are being sounded, tone generation of that pitch can be terminated at key-off timing of a leading one of the notes which is in a less-progressed tone generating stage than those of the others, because of the arrangement that the key-off operation is effected only when the number of to-be-sounded notes for that pitch reaches zero.

What is claimed is:

1. A performance control device comprising:

a first section that supplies performance data;

a second section that executes control to change tone-generation start time of a tone based on the performance data supplied by said first section; and a third section that, when the tone-generation start time of the tone is changed via said second section, executes control to automatically change the duration of said tone in response to the changed tone-generation start time.

2. A performance control device as recited in claim 1 wherein said second section executes said control to delay said tone-generation start time of said tone in accordance with delay-instructing information.

3. A performance control device as recited in claim 1 wherein said third section executes said control to automatically change the duration of said tone in such a manner that tone-generation end time of the tone whose tone-generation start time has been changed via said second section and tone-generation start time of a next tone are maintained in a predetermined relationship.

4. A performance control device as recited in claim 3 wherein said third section executes said control to automatically change the duration of said tone in such a manner that, if an original tone-generation end time of said tone determined by the supplied performance data is ahead of the tone-generation start time of the next tone, actual tone-generation end time of the note whose tone-generation start time has been changed via said second section comes ahead of the tone-generation start time of the next tone.

5. A performance control device as recited in claim 3 wherein said third section executes said control to automatically change the duration of said tone in such a manner that, if an original tone-generation end time of said tone determined by the supplied performance data is behind the tone-generation start time of the next tone, actual tone-generation end time of the note whose tone-generation start time has been changed via said second section comes behind the tone-generation start time of the next tone.

6. A performance control device as recited in claim 1 wherein said second section executes said control to delay said tone-generation start time of said tone in accordance with delay-time setting information, and said third section executes an arithmetic operation to change the duration of said tone in accordance with a predetermined numerical expression using, as parameters, an original duration of said tone determined by the supplied performance data, the delay-time setting information and a musical beat time length of said tone.

7. A performance control device as recited in claim 1 wherein said second section executes the control to change tone-generation start time of any of a plurality of tones, based on the supplied performance data, which corresponds to selected beat timing.

8. A performance control device as recited in claim 1 wherein said second section executes the control to change tone-generation start time of each upbeat tone from among a plurality of tones based on the supplied performance data, to thereby impart a feeling of swing to a music performance based on the supplied performance data.

9. A performance control device as recited in claim 1 wherein said first section repeatedly supplies automatic performance data having a predetermined plural-beat pattern, and said second section executes the control to change tone-generation start time of a tone at each even-numbered beat in the pattern, for each repeated supply of the automatic performance data.

10. A tone generating device for generating tones on the basis of supplied performance data including at least data designating tone-generation start time and duration of notes to be sounded, said tone generating device comprising:

a tone-generation-start control section that starts tone generation of a note at timing specified by the data designating the tone-generation start time of the note;

a duration control section that terminates the tone generation of the note when the tone generation of the note started via said tone-generation-start control section has lasted for a period specified by the data designating the duration of the note; and a number-of-note indicating section that, for each of a plurality of pitches, indicates a total number of notes being simultaneously sounded at the pitch, wherein when tone generation of a note at a specific pitch is to be terminated, said duration control section decrements by one the total number of notes, for the specific pitch, indicated by said number-of-note indicating section and terminates tone generation of all the notes at the specific pitch once the decremented total number has reached zero.

11. A performance control method comprising:

a first step of supplying performance data;

a second step of executing control to change tone-generation start time of a tone based on the performance data supplied by said first step; and a third step of, when the tone-generation start time of the tone is changed via said second step, executes control to automatically change the duration of said tone in response to the changed tone-generation start time.

12. A performance control method as recited in claim 11 wherein said second step executes said control to delay said tone-generation start time of said tone in accordance with delay-instructing information.

13. A performance control method as recited in claim 11 wherein said third step executes said control to automatically change the duration of said tone in such a manner that tone-generation end time of said tone whose tone-generation start time has been changed via said second step and tone-generation start time of a next tone are maintained in a predetermined relationship.

14. A performance control method as recited in claim 11 wherein said second step executes said control to change tone-generation start time of said tone in accordance with delay-time setting information, and said third step executes an arithmetic operation to change the duration of said tone in accordance with a predetermined numerical expression using, as parameters, an original duration of the note determined by the supplied performance data, the delay-time setting information and a musical beat time length of said tone.

15. A performance control method as recited in claim 11 wherein said first step repeatedly supplies automatic performance data having a predetermined plural-beat pattern, and said second step executes the control to change tone-generation start time of a tone at each even-numbered beat in the pattern, for each repeated supply of the automatic performance data.

16. A machine-readable recording medium containing a group of instructions of a program to be executed by a computer, said program comprising:

a first step of supplying performance data;

a second step of executing control to change tone-generation start time of a tone based on the performance data supplied by said first step; and a third step of, when the tone-generation start time of said tone is changed via said second step, executes control to automatically change the duration of said tone in response to the changed tone-generation start time.

17. A machine-readable recording medium as recited in claim 16 wherein said second step executes said control to delay said tone-generation start time of said tone in accordance with delay-instructing information.

18. A machine-readable recording medium as recited in claim 16 wherein said third step executes said control to automatically change the duration of said tone in such a manner that tone-generation end time of said tone whose tone-generation start time has been changed via said second step and tone-generation start time of a next tone are maintained in a predetermined relationship.

19. A machine-readable recording medium as recited in claim 16 wherein said second step executes said control to change tone-generation start time of said tone in accordance with delay-time setting information, and said third step executes an arithmetic operation to change the duration of said tone in accordance with a predetermined numerical expression using, as parameters, an original tone-generation lasting time of said tone determined by the supplied performance data, the delay-time setting information and a musical beat time length of said tone.

20. A machine-readable recording medium as recited in claim 16 wherein said first step repeatedly supplies automatic performance data having a predetermined plural-beat pattern, and said second step executes the control to change tone-generation start time of a tone at each even-numbered beat in the pattern, for each repeated supply of the automatic performance data.

* * * * *